US007857639B1

(12) United States Patent
Chang

(10) Patent No.: US 7,857,639 B1
(45) Date of Patent: Dec. 28, 2010

(54) SAFETY ELECTRIC CONNECTOR

(75) Inventor: His-Fan Chang, Guangdong (CN)

(73) Assignee: General Jack Technology Ltd., Guangdong (CN)

( * ) Notice: Subject to any disclaimer, the term of this patent is extended or adjusted under 35 U.S.C. 154(b) by 0 days.

(21) Appl. No.: 12/688,698

(22) Filed: Jan. 15, 2010

(51) Int. Cl.
*H01R 13/44* (2006.01)

(52) U.S. Cl. ..... 439/131; 439/172

(58) Field of Classification Search ..... 439/131, 439/171, 172, 173
See application file for complete search history.

(56) References Cited

U.S. PATENT DOCUMENTS 5,474,464 A * 12/1995 Drewnicki ..... 439/172
7,125,265 B2 * 10/2006 Weng ..... 439/131
7,354,286 B1 * 4/2008 Lee ..... 439/172
2004/0127080 A1 * 7/2004 Chen ..... 439/172
2005/0153588 A1 * 7/2005 Liao ..... 439/172

* cited by examiner

*Primary Examiner*—Hien Vu
(74) *Attorney, Agent, or Firm*—Banger Shia

(57) ABSTRACT

A safety electric connector includes a main housing, a first plug and a second plug. The first and second plugs are in two different types and can be extended or retracted. The main housing has a chamber therein and a pair of socket holes formed on a top surface thereof. The main housing comprises two first conductive arms, two second conductive arms, two switching members and two connecting members therein. The connecting members and the switching members can be connected or disconnected. One of the plugs is moved to switch the switching member for controlling disconnection/connection of the connecting members and the switching members. Accordingly, the plug which is extended alone has a normal converting function. When both the plugs are pushed out simultaneously, only one plug has the converting function and the other plug doesn't conduct electricity. Therefore, the present invention can avoid any electric shock accidents when both plugs are pushed out, ensuring the safety of the connector when in use.

3 Claims, 6 Drawing Sheets

SAFETY ELECTRIC CONNECTOR

BACKGROUND OF THE INVENTION

1. Field of the Invention

The present invention relates to an electric connector, in particular to a safety electric connector.

2. Description of the Prior Art

An electric connector is adapted for different types of plug and socket. The connector provides convenience for those who often go abroad on business or take a trip to match with different plugs in other countries, such as America, England, or Europe. A conventional connector comprises a housing therein. Different types of feet and socket are disposed in the housing. The feet can be any combination of English rectangular-type plugs, American flat-type plugs, or European cylinder-type plugs. These feet can be hidden in the housing when not in use. When in use, the matching feet are pushed out. The conventional connector can achieve the basic converting function. However, there are many shortcomings existing in the prior art. When multiple feet are extended out simultaneously, they all conduct electricity. When the exposed feet are not used, it is easy to cause an electric shock accident.

SUMMARY OF THE INVENTION

The primary object of the present invention is to provide a safety electric connector. When two pairs of feet are pushed out simultaneously, one pair of the feet doesn't conduct electricity and only the other pair of feet conducts electricity so as to solve the safety problems existing in the prior art.

According to the present invention, there is provided a safety electric connector comprising a main housing, a first plug and a second plug, the first and second plugs being in two different types, the main housing having a chamber therein, the first and second plugs being movably mounted in the chamber; the main housing including a pair of socket holes formed on a top surface thereof and two metallic reeds disposed under the pair of socket holes and fixed in the chamber; two slots disposed on two sides of the main housing for extending or retracting the first and second plugs; the first plug comprising a first insulation base, a pair of first feet fixed to the first insulation base, and two first push buttons for acting the first insulation base to slide, the first insulation base being inserted with a pair of first contact plates for connecting with the pair of first feet; the second plug comprising a second insulation base, a pair of second feet fixed to the second insulation base, and a second push button for acting the second insulation base to slide, the second insulation base being inserted with a pair of second contact plates for connecting with the pair of second feet; the first push button and the second push button being inserted in the slots to slide along the slots upward and downward; the chamber being provided with first conductive arms, second conductive arms, connecting members and switching members, the first conductive arms and the switching members being electrically connected with the metallic reeds all the time, the second conductive arms being electrically connected with the connecting members all the time, the switching members being disposed between the connecting members and the first plug, the first insulation base being provided with an upper push portion and a lower push portion for driving the switching members to connect or disconnect with the connecting members.

The present invention provides the connecting members and the switching members to disconnect from or connect with each other. One of the plugs is moved to switch the switching members for controlling disconnection/connection of the connecting members and the switching members. Accordingly, the plug which is pushed out alone has a normal converting function. When both the plugs are pushed out simultaneously, only one plug has the converting function and the other plug doesn't conduct electricity. Therefore, the present invention can avoid any electric shock accidents when both plugs are pushed out, ensuring the safety of the connector when in use.

DETAILED DESCRIPTION OF THE PREFERRED EMBODIMENTS

Figure 1:
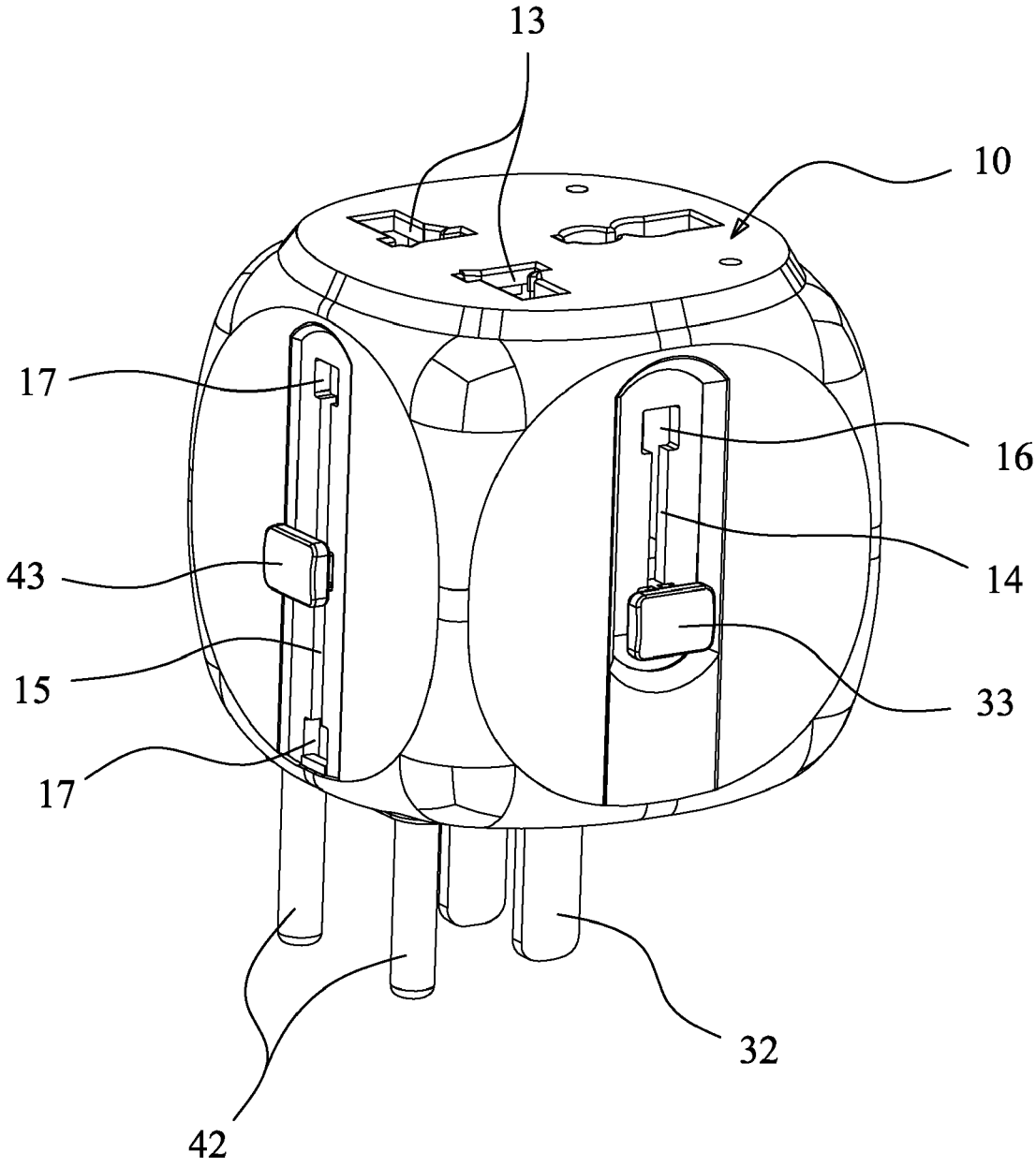
FIG. 1 is a perspective view according to a preferred embodiment of the present invention.
Figure 2:
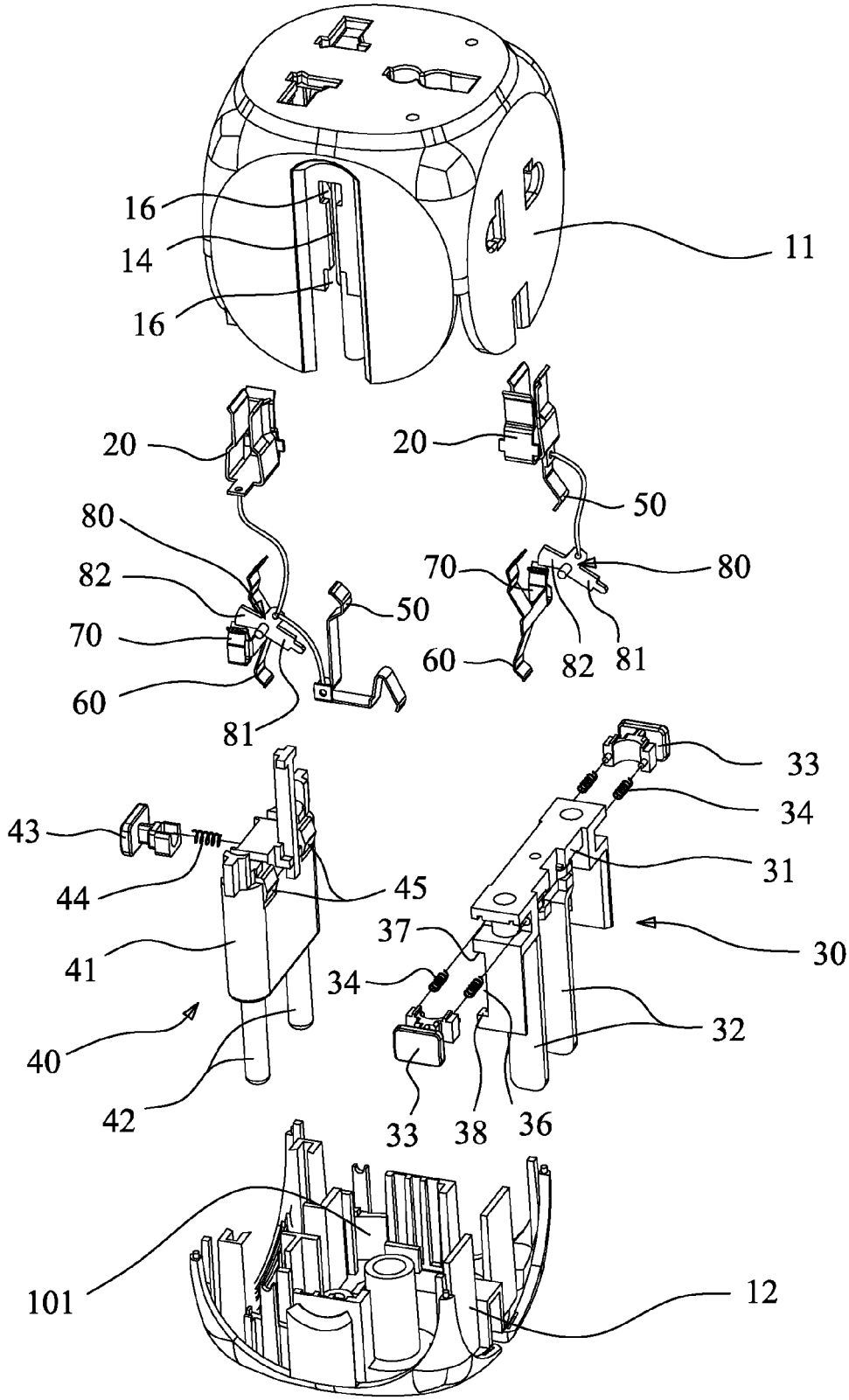
FIG. 2 is an exploded view according to the preferred embodiment of the present invention.
Figure 3:
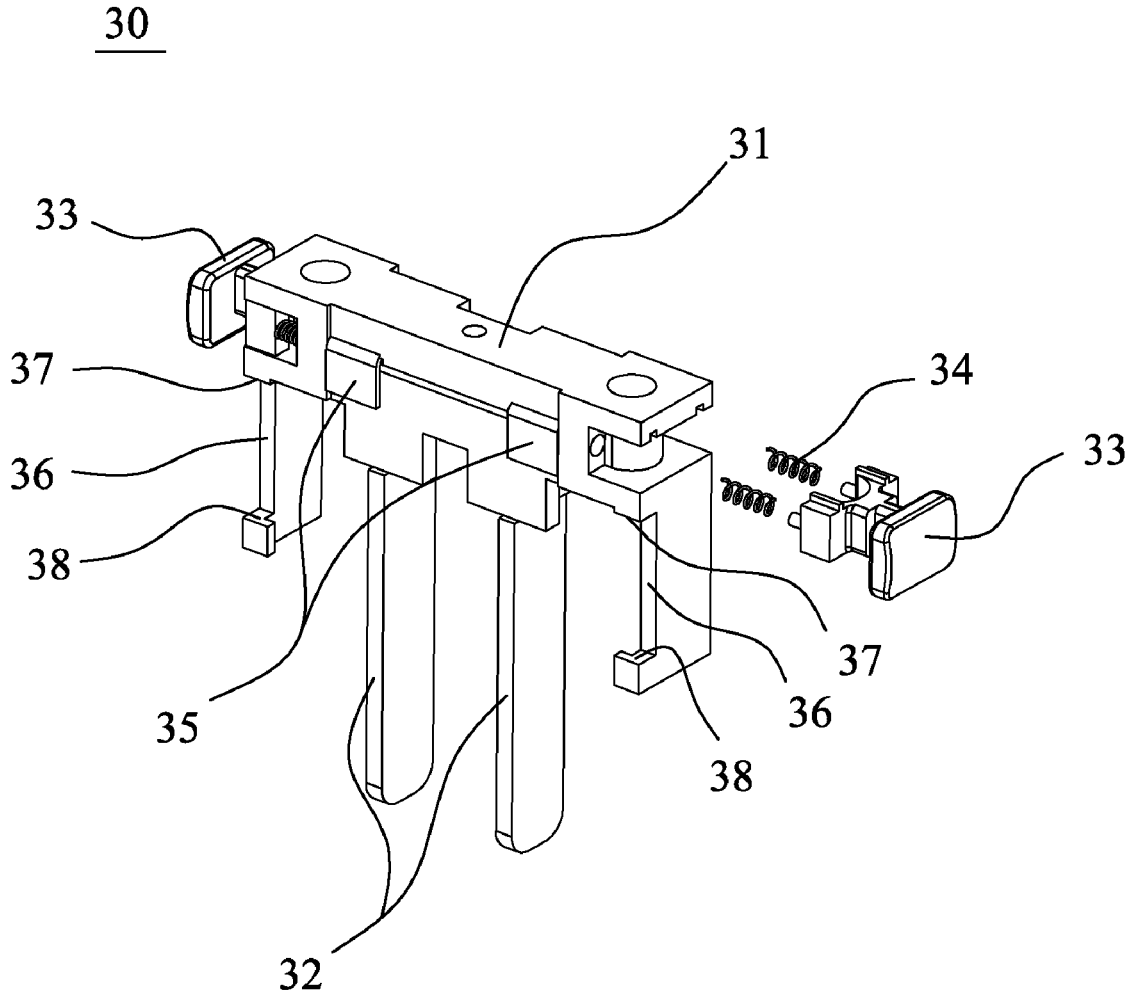
FIG. 3 is an enlarged view of the first plug according to the preferred embodiment of the present invention.

Embodiments of the present invention will now be described, by way of example only, with reference to the accompanying drawings.

As shown in FIG. 1 to FIG. 6, a preferred embodiment of the present invention comprises a main housing 10, two metallic reeds 20, a first plug 30, a second plug 40, two first conductive arms 50, two second conductive arms 60, two connecting members 70, and two switching members 80. The first plug 30 and the second plug 40 can be any two of English rectangular-type plugs, American flat-type plugs, or European cylinder-type plugs.

The main housing 10 has a hexahedral shape with six sides. In this embodiment, the main housing 10 is composed of an upper housing 11 and a lower housing 12. The main housing 10 has a chamber 101 therein. The main housing 10 includes a pair of socket holes 13 formed on a top surface thereof, a first slot 14 and a second slot 15 formed on two sides thereof for the first plug 30 and the second plug 40 to slide therein. The first slot 14 and the second slot 15 are parallel each other. The first plug 30 and the second plug 40 extend out from a bottom surface of the main housing 10, and are parallel to slide downward and upward. The first slot 14 has one end formed with a first limit hole 16, and the second slot 15 has one end formed with a second limit hole 17.

The two metallic reeds 20 are fixed in the chamber 101 of the main housing 10 and located underneath the pair of socket holes 13 for connecting with feet of an inserted plug.

The first plug 30 is movably mounted in the chamber 101 of the main housing 10. The first plug 30 comprises a first insulation base 31, a pair of first feet 32, and two first push buttons 33. The pair of first feet 32 is fixed to a lower end of the first insulation base 31. The two first push buttons 33 are coupled to two opposite ends of the first insulation base 31 and hold against two first return springs 34, respectively, for moving the first insulation base 31 and the pair of first feet 32 synchronously. Each first push button 33 has a middle portion which is inserted in the first slot 14 of the main housing 10. By using the first return spring 34 to push the first push button 33 outward, the first push button 33 can be pressed to slide upward and downward and engaged with the first limit hole 16, such that the pair of first feet 32 of the first plug 30 can be retracted in the main housing 10 or pushed out from the main housing 10. One side of the first insulation base 31 is inserted with a pair of first contact plates 35 for electrically connecting with the pair of first feet 32. The side of the first insulation base 31 is formed with a notch 36 and an upper push portion 37 and a lower push portion 38 which are located at two ends of the notch 36 and used to push the switching member 80.

The second plug 40 is movably mounted in the chamber 101 of the main housing 10. The second plug 40 comprises a second insulation base 41, a pair of second feet 42, and a second push button 43. The pair of second feet 42 is fixed to a lower end of the second insulation base 41. The second push button 33 is coupled to one side of the second insulation base 41 and hold against a second return spring 44 for moving the second insulation base 41 and the pair of second feet 42 synchronously. The second push button 43 has a middle portion which is inserted in the second slot 15 of the main housing 10. By using the second return spring 44 to push the second push button 43 outward, the second push button 43 can be pressed to slide upward and downward and engaged with the second limit hole 17, such that the pair of second feet 42 of the second plug 40 can be retracted in the main housing 10 or extended out from the main housing 10. Another side of the second insulation base 41 is inserted with a pair of second contact plates 45 for electrically connecting with the pair of second feet 42.

The two first conductive arms 50 are movably contact with the pair of first contact plates 35 of the first plug 30 and electrically connected with the two metallic reeds 20. In this embodiment, one of the first conductive arms 50 is integrally formed with one metallic reed 20, and the other first conductive arm 50 is electrically connected with the other metallic reed 20 via a conducting wire.

The two second conductive arms 60 are mounted in the chamber 101 of the main housing 10 and are movably contact with the pair of second contact plates 45 of the second plug 40.

The two connecting members 70 are mounted in the chamber 101 of the main housing 10, and electrically connected to the two second conductive arms 60, respectively. In this embodiment, the connecting member 70 and the second conductive arm 60 are integrally formed by stamping a thin metallic plate. The two connecting members 70 are movably contact with the two switching members 80, respectively. In this embodiment, each of the two connecting members 70 is a clamp having two clamp arms. The two clamp arms are adapted to clamp the switching member 80 tightly so as to get a firm electric connection.

Each of the two switching members 80 are used to control connection and disconnection of the connecting member 70 and the metallic reed 20. The two switching members 80 are pivotally mounted in the chamber 101 of the main housing 10 and located between the two connecting members 70 and the first plug 30, respectively. Each switching member 80 includes a driving arm 81 and a driven arm 82 at two sides thereof. The driving arm 81 extends into the notch 36 of the first plug 30 and located between the upper push portion 37 and the lower push portion 38. The driven arm 82 extends above the connecting member 70. When the lower push portion 38 pushes the driving arm 81 to move up, the driven arm 82 will move downward to be inserted between the two clamp arms of the connecting member 70 for electric connection. When the upper push portion 37 pushes the driving arm 81 to move downward, the driven arm 82 will disengage from the connecting member 70 for disconnection. The two switching members 80 are electrically connected with the two first conductive arms 50, respectively. In this embodiment, the switching member 80 is electrically connected with the first conductive arm 50 via a conducting wire.

In this embodiment, there are three types of usage, namely, the first plug 30 is pushed out alone, the second plug 40 is pushed alone, and both the first plug 30 and the second plug 40 are pushed out simultaneously. The detailed embodiments are described below.

For pushing the first plug 30 out alone, the first push button 33 is operated to push the first plug 30 to slide downward along the first slot 14, so that the pair of first feet 32 extends out from the main housing 10 for connecting with a matching socket. The first contact plates 35 of the first plug 30 are contact with the first conductive arm 50s for electric connection. Because the first conductive arm 50 and the metallic reed 20 are connected all the time via the conducting wire, the metallic reed 20 gets the power source from the first plug 30.

Figure 4:
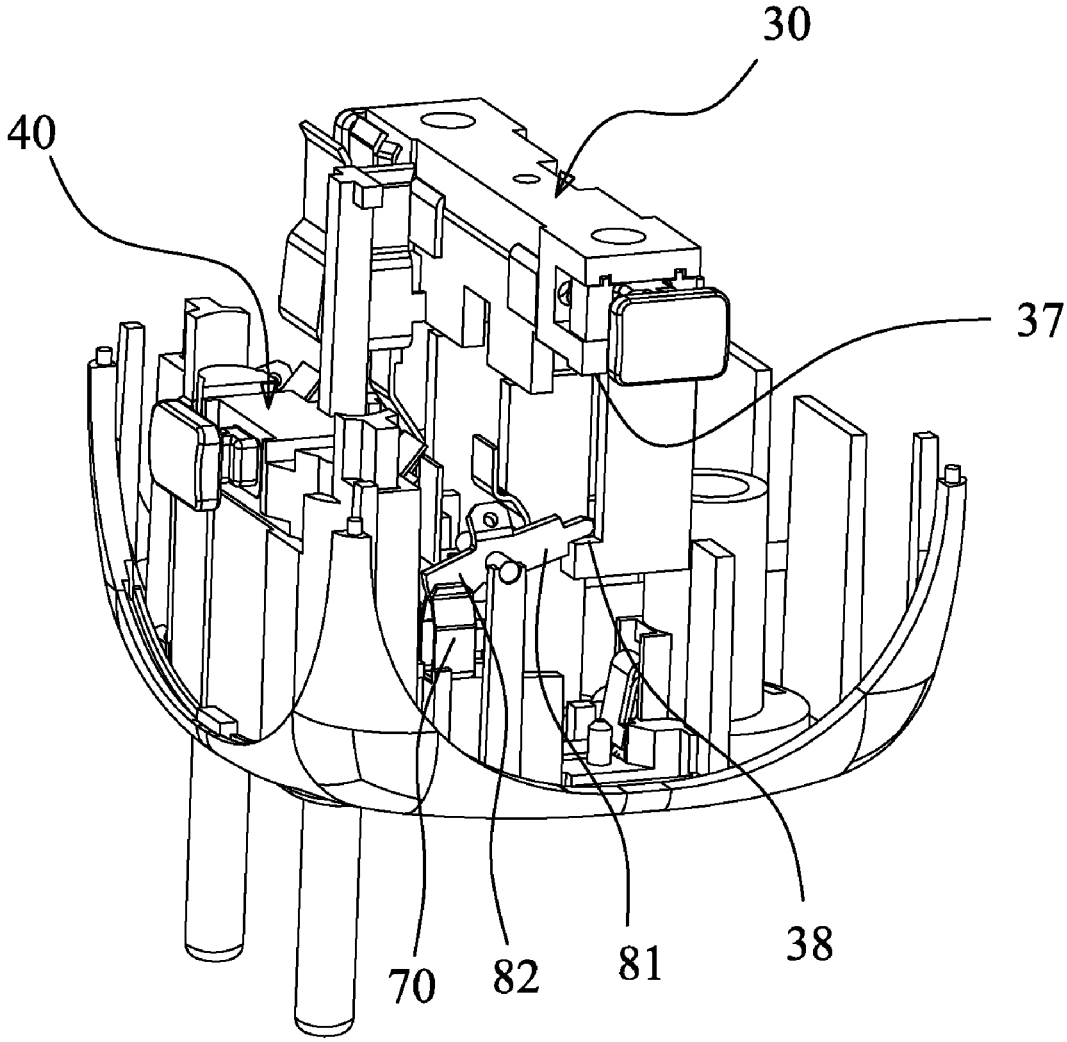
FIG. 4 is a partially assembled view according to the preferred embodiment of the present invention.

For pushing the second plug 40 out alone, the second push button 43 is operated to push the second plug 40 to slide downward along the second slot 15, so that the pair of second feet 42 extends out from the main housing 10 for connecting with a matching socket. The second contact plates 45 of the second plug 40 are contact with the second conductive arms 60 for electric connection. At the same time, the first plug 30 is retracted in the main housing 10, as shown in FIG. 4. The lower push portion 38 of the first plug 30 pushes the driving arm 81 up, and the driven arm 82 is inserted between the clamp arms of the connecting member 70. The connecting member 70 is electrically connected with the metallic reed 20 via the switching member 80 and the conducting wire. Accordingly, the second plug 40 is electrically connected with the metallic reed 20, such that the metallic reed 20 gets the power source from the second plug 40.

Figure 5:
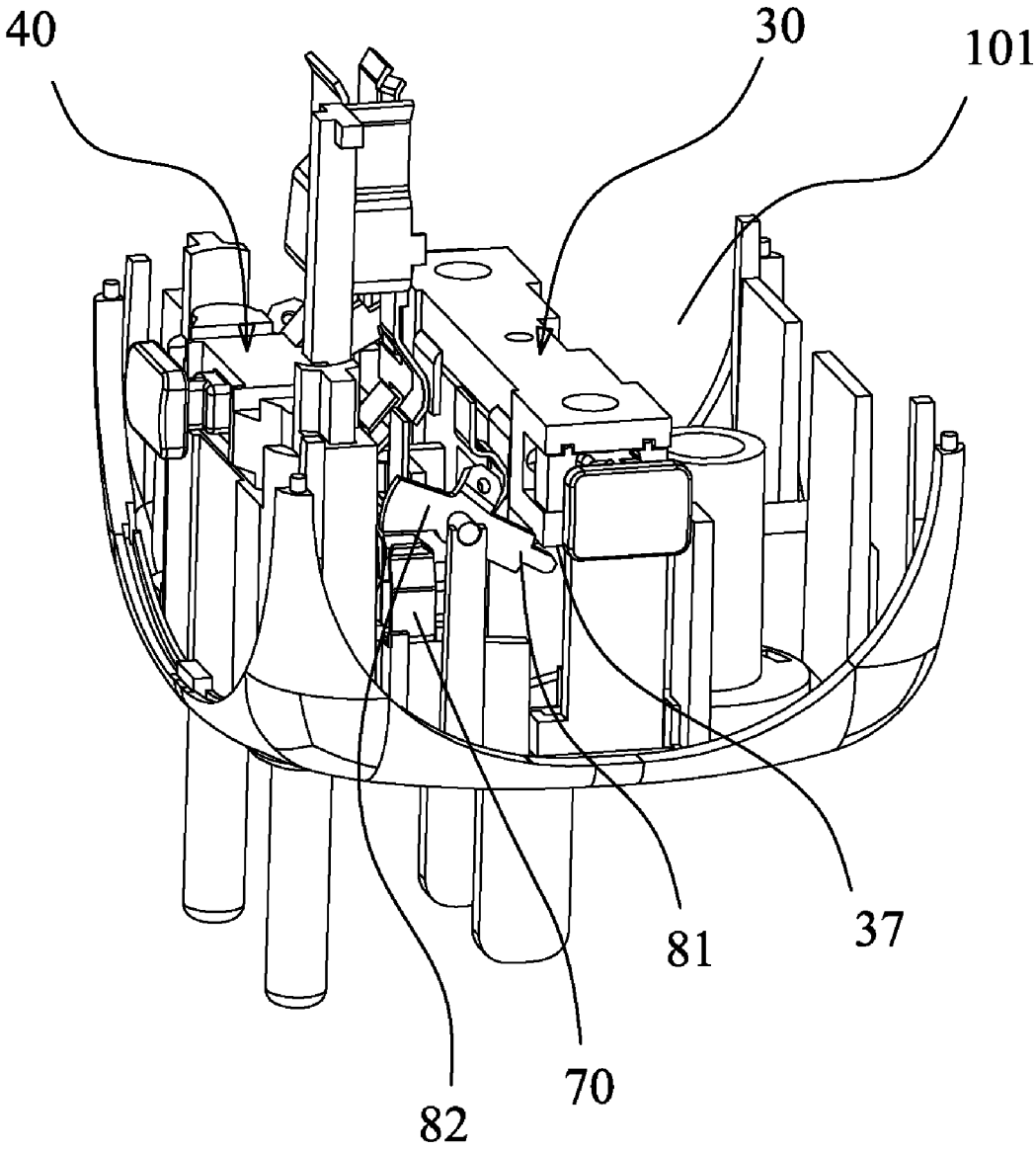
FIG. 5 is a schematic view of FIG. 4 in another status.
Figure 6:
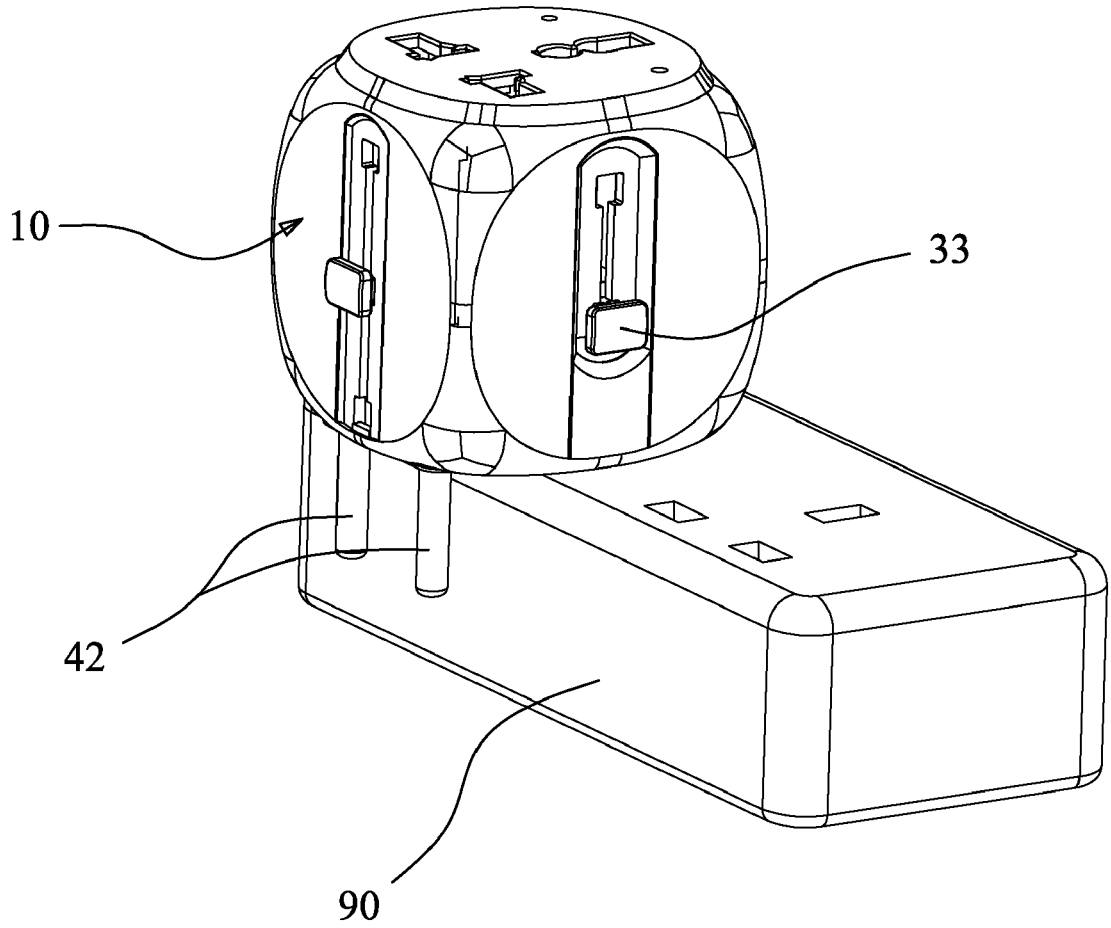
FIG. 6 is a schematic view according to the preferred embodiment of the present invention when in use.

For pushing both the first plug 30 and the second plug 40 out, the first plug 30 is pushed out, as shown in FIG. 5, and the upper push portion 37 of the first plug 30 pushes the driving arm 81 of the switching member 80 to move downward, such that the driven arm 82 is turned upward to disengage from the connecting member 70 for disconnection, namely, the metallic reed 20 and the second conductive arm 60 are in a disconnection status. Accordingly, the second plug 40 is pushed downward, such that the second contact plates 45 of the second plug 40 are connected with the connecting members 70 and the second conductive arms 60. The pair of second feet 42 of the second plug 40 won't be electrified.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A safety electric connector, comprising a main housing, a first plug and a second plug, the first and second plugs being in two different types, the main housing having a chamber therein, the first and second plugs being movably mounted in the chamber; the main housing including a pair of socket holes formed on a top surface thereof and two metallic reeds disposed under the pair of socket holes and fixed in the chamber; two slots disposed on two sides of the main housing for extending or retracting the first and second plugs; the first plug comprising a first insulation base, a pair of first conductive feet fixed to the first insulation base, and two first push buttons with first springs for acting the first insulation base to slide, the first insulation base being formed with a pair of first contact plates for connecting with the pair of first feet; the second plug comprising a second insulation base, a pair of second conductive feet fixed to the second insulation base, and a second push button with second spring for acting the second insulation base to slide, the second insulation base being formed with a pair of second contact plates for connecting with the pair of second feet; the first push buttons and the second push button being inserted in the slots to slide along the slots upward and downward; the chamber being provided with first conductive arms, second conductive arms, connecting members and switching members, the first conductive arms and the switching members being electrically connected with the metallic reeds all the time, the second conductive arms being electrically connected with the connecting members all the time, the switching members being disposed between the connecting members and the first plug, the first insulation base being provided with an upper push portion and a lower push portion for driving the switching members to connect or disconnect with the connecting members;

when the first plug is pushed out, the pair of first conductive feet being extended outwardly from the main housing, the first contact plates of the first plug being contact with the first conductive arms for electric connection for the pair of first feet to connect with the metallic reeds to form an electric connection, the upper push portion pushing the switching member to disengage from the connecting members for the second conductive arms to disconnect with the metallic reeds;

when the first plug is retracted, the first contact plates of the first plug disengaging from the first conductive arms for disconnection of the pair of first feet and the metallic reeds, the lower push portion pushing the switching members to be contact with the connecting members for electric connection, the second conductive arms being electrically connected with the metallic reeds;

when the second plug is pushed out, the pair of second conductive feet being extended outwardly from the main housing, the second contact plates of the second plug being contact with the second conductive arms for electric connection; and when the second plug is retracted, the second contact plates of the second plug disengaged from the second conductive arms for disconnecting electric connection.

2. The safety electric connector as claimed in claim 1, wherein the switching members are pivotally mounted in the chamber, the switching members each including a driving arm and a driven arm at two sides thereof, the driving arm being disposed between the upper push portion and the lower push portion, the driven arm being disposed beside the connecting member.

3. The safety electric connector as claimed in claim 1, wherein each of the connecting members is a clamp having two clamp arms.

* * * * *